United States Patent [19]

Ingelsten et al.

[11] Patent Number: 4,809,900

[45] Date of Patent: Mar. 7, 1989

[54] FASTENER SEPARATOR FOR A FASTENER DRIVING APPARATUS

[76] Inventors: Ragnar Ingelsten, Ingelsbo; Folke Nilsson, Folkungagatan 8, both of S-331 00 Värnamo, Sweden

[21] Appl. No.: 119

[22] Filed: Jan. 2, 1987

Related U.S. Application Data

[63] Continuation-in-part of Ser. No. 711,573, filed as PCT SE84/00239 on Jun. 25, 1984, published as WO85/00131 on Jan. 17, 1985, abandoned.

[30] Foreign Application Priority Data

Jun. 22, 1983 [SE] Sweden ..... 8303575-8

[51] Int. Cl.[4] ..... B25C 1/04; B27F 7/13

[52] U.S. Cl. ..... 227/116; 227/115; 227/120

[58] Field of Search ..... 227/115, 116, 120, 130, 227/138

[56] References Cited

U.S. PATENT DOCUMENTS

| | | | |
|---|---|---|---|
| 696,968 | 4/1902 | Hebert | 227/115 |
| 717,040 | 12/1902 | Smith . | |
| 928,645 | 7/1909 | Evans et al. | 227/115 |
| 969,934 | 9/1910 | Ballard | 227/115 |
| 1,786,087 | 12/1930 | Pucar | 227/115 |
| 2,186,841 | 1/1940 | Rylander | 227/116 |
| 2,569,891 | 10/1951 | Holter | 227/116 |
| 2,783,468 | 3/1957 | Schwartz | 227/116 |
| 2,806,219 | 9/1957 | Cavanaugh | 227/116 |
| 2,947,991 | 7/1958 | Collum et al. . | |
| 3,041,617 | 7/1962 | Parr | 227/116 |
| 3,086,207 | 4/1963 | Lingle et al. . | |
| 3,524,576 | 8/1970 | Bader . | |
| 3,622,062 | 11/1971 | Goode et al. . | |
| 3,893,610 | 7/1975 | Smith | 227/116 X |
| 4,463,888 | 8/1984 | Geist et al. | 227/119 |

FOREIGN PATENT DOCUMENTS

| | | | |
|---|---|---|---|
| 2623105 | 12/1977 | Fed. Rep. of Germany . | |
| 0335197 | of 0000 | France | 227/115 |

*Primary Examiner*—P. W. Echols
*Assistant Examiner*—Taylor J. Ross
*Attorney, Agent, or Firm*—Merchant, Gould, Smith, Edell, Welter & Schmidt

[57] ABSTRACT

The subject matter of the invention is a driving apparatus for fasteners each of which has a shank and a head, and a characteristic of the invention is that a feeding mechanism for feeding fasteners from a magazine for a row of fasteners to a laterally offset firing track in the apparatus is in the form of a reciprocatory slide the path of movement of which is perpendicular both to the row of fasteners and to the fastener firing track of the apparatus, that the slide has two opposite arms with oblique end surfaces forming a gate device which is movable during the movement of the slide to allow one fastener at a time to pass from the magazine to the firing track, and that one arm of the slide serves as a separating means which during the movement of the slide in one direction is moved in between the fastener introduced into the gate device and the next following fastener so that these fasteners are separated from one another, and which at the same time positively moves the fastener introduced into the gate device through the gate device to the firing track under the collaboration of a stationary stop means which prevents the fastener introduced into the gate device from moving together with the slide.

4 Claims, 6 Drawing Sheets

FASTENER SEPARATOR FOR A FASTENER DRIVING APPARATUS

This application isa continuatrion-in-part application of the earlier filed application Ser. No. 711,573 filed as PCT SE84/00239 on Jun. 25, 1984, published Jan. 17, 1985, now abandoned.

This invention relates to apparatuses for driving fasteners of the type having shanks with an end to be driven into work and an opposite end against which the driving apparatus acts.

A customary type of fasteners to be operated by means of an apparatus according to the invention are nails having a pointed end and a head at the opposite end, but it is also conceivable to use an apparatus according to the invention for driving other fasteners into workpieces, such as screws, tacks etc. which can be fed into a firing track in the driving apparatus via a suitable guide.

It is prior art to provide fastener driving apparatuses with a separating means which, when a row of fasteners—for greater simplicity hereinafter called nails—are fed from a magazine, is moved into the row and separates the leading nail from the other nails in the row, for delivering that nail into a firing track, where it can be struck by a piston rod which is driven by pressure fluid via a piston and acts as a nail driver and is capable of driving said separated nail into a work-piece without touching the next following nail in the row.

A problem is here encountered in that the separating means also has to be kept out of the way of the driver during the driving stroke. It must be possible to move the separating means to the separating station and back to a free position at an equally rapid rate as the driving sequence of the driver, without being exposed at any time to the risk of being damaged by the impact means. The movement of the driver at least in one direction of its reciprocating movement is brought about by pressure fluid, usually the return air which returns the driver after the driving stroke, and the pressure air for driving the separating means is controlled by valve mechanism operating in step with the driving sequence.

Usually, only driving apparatuses for "bulk nails", i.e. nails not laterally interconnected to form a strip of nails, require a separating means but on the other hand it is desirable for a bulk nail driving apparatus to be useful also with strips of nails or, more generally, strips of fasteners.

It has been known for a time to provide driving apparatuses of the aforementioned kind with separating means driven by a separating piston operable by a pressurized fluid, such as air, which also drives the main piston movable in a main cylinder and connected to the nail driver. This known separating means comprises a separating member in the slide which is reciprocable in a guide track for fasteners by means of said separating piston. The usual way of operating the separating slide in one direction is to make use of the compressed air which operates the piston in the main cylinder. To prevent the separating means and/or the driver from being damaged at the firing stroke, it is necessary for the separating means to be disengaged from the nail when the latter has been fed to its firing station, and to be returned into engagement between said fed fastener and the next following fastener during the return stroke of the driver. In most prior art driving apparatuses with separating means said means operates in this manner as does the separating means of the present invention. By way of example, reference is made to U.S. Pat. Nos. 4,463 888, 3,524,576 and 3,622,062 and to European patent application No. 79103098.4 bearing Publication No. 0,008,749.

None of the solutions of the separating problem disclosed hitherto permits an unproblematic separation of the leading nail from the following nails in a strip of nails in driving apparatuses for driving so-called bulk nail, i.e. nails not laterally interconnected to form a strip of nails. The separating mechanism disclosed in U.S. Pat. No. 3,622,062 comprises a spring biased nail separating pawl which is capable of separating a nail in a row of nails only on condition that the nails of the row of nails are spaced apart in advance, and to bring about this the nails have to be kept at a distance from each other. U.S. Pat. No. 3,524,576 discloses a similar device wherein the separating means which resembles a tuning fork, is movable by means of an operating piston and during its movement also performs a pivotal movement for catching a nail between the fork prongs of the separating means. This device too requires that the nails are kept at definite distances from each other. In other words, the device is suited only for strips of connected nails.

The separating means according to the above-mentioned European patent application No. 79103098.4 comprises a spring biased piston supporting a nail separating pin which is intended to be moved in between two nails of a row of nails. For an unobstructed operation of this separating pin, the fasteners must be round wire nails with smooth surfaces and these nails have to be advanced in a row without any overlap of the nail heads so that the piston-driven pin can readily find its way in between the leading nail and the next following nail of the row in order to afford the leading nail a free passage to the firing track while keeping the other nails back. This separating device is not suitable for nailing guns or nailing apparatuses of practical standard design or manufacture, but possibly for expensive precision-made special apparatuses and for "ideal nails", i.e. mutually exactly similar nails with round smooth shanks of mutually equal weight, and even if the nails are "ideal nails", the separating pin, in case of varying angles between adjacent nails, may hit a nail shank which in spite of the fact that it is round cannot slide aside because it is obstructed by the next following nail in the row. On manual operation of the nailing gun, this can possibly be tolerated, but not if the nailing gun is used in a nailing station for automatic driving of nails into automatically supplied work.

For the sake of completeness, mention should also be made of the construction described in U.S. Pat. No. 969,934. In this patent specification there is suggested a method of facilitating attaching the uppers to the inner soles of shoes with the use of a manually operated apparatus for tacking the soles, which corresponds in principle to a stapler but which ejects tacks instead of staples. This apparatus is equipped with a tack picker which, by a combined pivoting and translation movement, separates tacks from a row of tacks in a raceway and feeds each single tack into a firing track from where the tack is fired by means of a driver operated by hand.

U.S. Pat. No. 717,040 shows a tack picker and driver which is used in combination with a carpet stretcher. The tack picker is in the form of a separating slide which is situated at the bottom end of a track magazine and at a position above and well spaced from a driving or firing point beneath a tack driver. From the tack separating slide each separated tack is dropped into a hopper which is formed to turn the tack from a horizontal to a vertical position before the tack arrives at the firing point. This separating mechanism and the tack driver are hand-operated, and because of the fact that the tack separator is situated at a relatively long distance above the firing point and the tacks have to be turned 90° in a hopper before arriving at the firing point, this apparatus can only work in a vertical position and at a relatively low speed, which makes the apparatus unsuitable for rapid power driven operation. A further drawback is that a tack which is dropped into the hopper, may arrive at the firing station in the wrong position, in which case it will be jammed by the driver, whereupon the next separated tack will be dropped upon the jammed tack etc. When the driver is urged downward to hit the tack head, the driver the moment before strikes with full force against an oblique surface of a tack picker finger, whereby the tack picker is moved aside and allows the tack to pass to a position to be fired into the workpiece. At a continued downward movement of the driver the tack picker is moved further aside by the force of the driver to supply the next tack.

The mechanism for feeding and firing tacks is here relatively sensitive to disturbances in that the movement (oscillation) of the tack picker is guided by a pin which is supported by the driver and engages an S-shaped slot formed in a pivotable lever supporting the picker. The lever must be sufficiently resilient to be transversely displaceable and must be movable also in its own plane. Such a system with a tack picker supported by an oscillating lever is not capable of effecting exact feeding movements. A most serious drawback is that the picker is not kept out of the way of the driver during the firing stroke but is hit by it at each firing stroke. Moreover, the driver proper is utilized to provide the requisite oscillating movements by mechanically striking the tack picker.

U.S. Pat. No. 4,463,888 discloses a nailing apparatus which comprises a separating slide (termed "escapement member") which must make a reciprocatory movement in order to supply a nail to the firing station when this slide is moved to the left from an end position, a first arm thereof moved in between the leading nail and the next following nail in the row of nails from the magazine, simultaneously as a second arm (stopper) is moved away from the outermost nail. On continued movement of the first arm to the left, the nail is moved toward the driving or "firing" track, but this movement is unable to move the leading nail in the row to the firing position. When the piston is moved back to the right, the second arm pushes the outermost nail in the row toward the firing position, simultaneously as the first arm is moved away therefrom. These two arms cannot, not even together, move the nail all the way to the firing position. Instead, the final displacement movement is accomplished by a magnet assembly. In view hereof, the nail advance is comparatively slow and also uncertain in that it is dependent upon the reciprocating movement of the slide and the displacement of the respective nails first by one arm and then the other, with an intermission in the advance.

To bring some order into the separating and nail feeding movement, said first arm is equipped with a spring biased pin. The pin cannot be dispensed with because, if it were removed, the spring mechanism in the magazine may, in some positions of the slide, push the entire row of nails up to the firing track.

One of the reasons of this problem is that the path of nail travel from the magazine to the firing position lies in the plane of the firing track proper. In this instance, a complete nail advance could, by a direct displacement by means of the said second arm, easily block the nail driving tool.

These drawbacks may be tolerated in a simple manually operated apparatus for driving small tacks and the like, but would be devastating in a pressure fluid operated nailing gun.

The object of the invention is to provide a fastener driving apparatus which will eliminate the problems and which comprises a power operated fastener driver.

Another object is to provide, for use in such an apparatus, a separating mechanism which is a relatively simple construction and which will operate for fail-safe separation and distribution of nails or other fasteners from a row of fasteners of any customary type, such as grooved wire nails and nails having circular cross-section.

A further object of the invention is to provide, for use in the apparatus outlined above, a fastener separating mechanism which is reciprocable in synchronism with the operation of the driver for separating the leading fastener from the next falling fastener in a row of fasteners and for delivering each separated fastener into a firing station in a correct position to be received and held by receiving means in a position to be struck by the driver and thereby forced to penetrate into a workpiece.

Thus, in order to accomplish these objects there is provided, according to the invention, a driving apparatus for fasteners, each of which comprises a shank with a head at one end and an opposite end formed to be driven into a workpiece, such as nails, the apparatus comprising a housing having a nose portion, means including a reciprocable power driven first piston serving as a fastener driver and movably mounted in said housing, said nose portion having a guide means which forms a driver guide for said driver and a firing track for guiding fasteners which are to be moved along said track into a workpiece one by one by a blow from said driver at each driving stroke thereof, said driver guide and said firing track having a common longitudinal axis, a magazine having a guiding device for a row of fasteners, a feeding mechanism for feeding one fastener at a time from said row into the firing track, said feeding mechanism comprising a reciprocably mounted slide means supported by said slide for separating the outermost one of said fasteners in said row from the following fasteners to permit the separated fastener to be moved into a firing position in said firing track by means of said feeding mechanism, said nose portion having a transverse slide guide for guiding said reciprocable slide back and forth along a path extending at least substantially perpendicular to and through the path of movement of the row of fasteners towards the firing track, the path of movement of said slide extending substantially perpendicular also to said common longitudinal axis of said driver guide and said firing track, slide driving means for reciprocation of said separating member in timed relationship with the operation of said driver, said nose portion further comprising a fastener receiving station arranged therein for receiving each fastener fed from said magazine, channel means and means for placing said magazine in communication with said channel means, said channel means comprising a fastener supporting surface which extends substantially perpendicular to said slide guide and substantially parallel to said firing track, said fastener separating means comprising first and second projections having adjacent spaced-apart ends which define a passage for fasteners therebetween, said first projection having means arranged to form a temporary obstacle to movement of the outermost one of said fasteners in said row, and said second projection forming a fastener separating member which, when said slide is moved in one direction, is movable in between said outermost and the next following one of the fasteners in said row to separate said outermost fastener in the row from the other fasteners therein, said second projection comprising means for pushing said outermost fastener transversely to a resting position in contact with said supporting surface and for moving said separated fastener from said resting position in said station to said firing position in said firing track, and said nose portion comprising magnetic means for maintaining said fastener in said firing position until being struck by said driver and thereby moved along said track into said workpiece.

A further object is to provide the apparatus defined above with a nail magazine of a new design.

The invention will now be described in more detail below with reference to the accompanying drawings in which.

Figure 2:
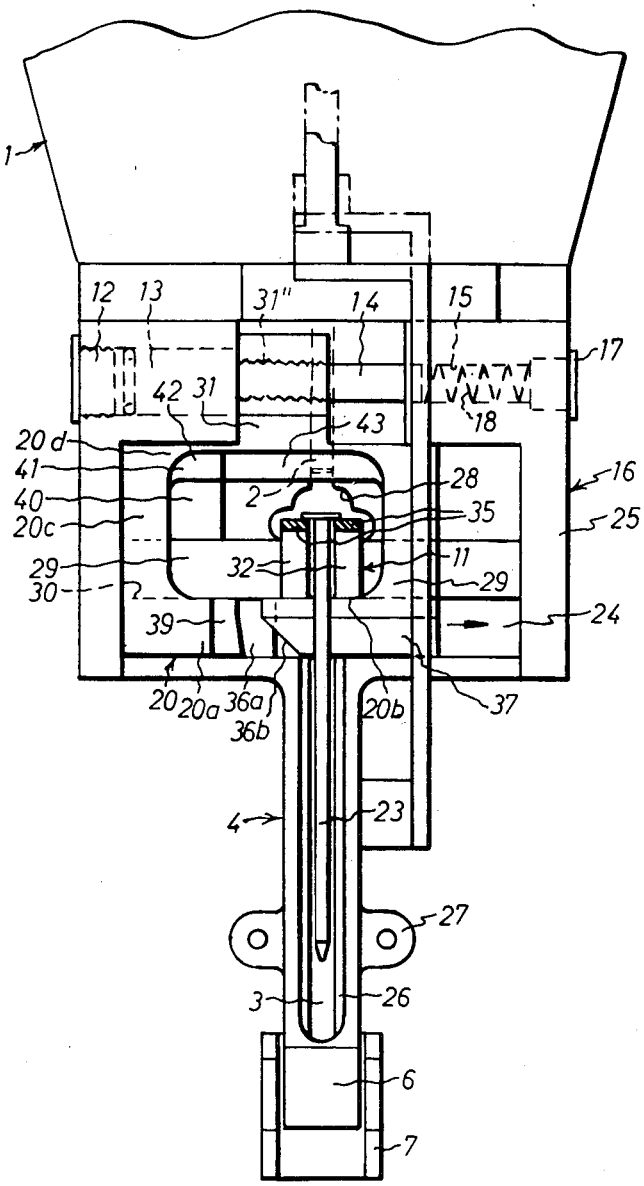
FIG. 2 shows the lower part of the apparatus on a larger scale in vertical section on the line II—II in FIG. 1, i.e. substantially in the boundary surface between the apparatus proper and the magazine.
Figure 4:
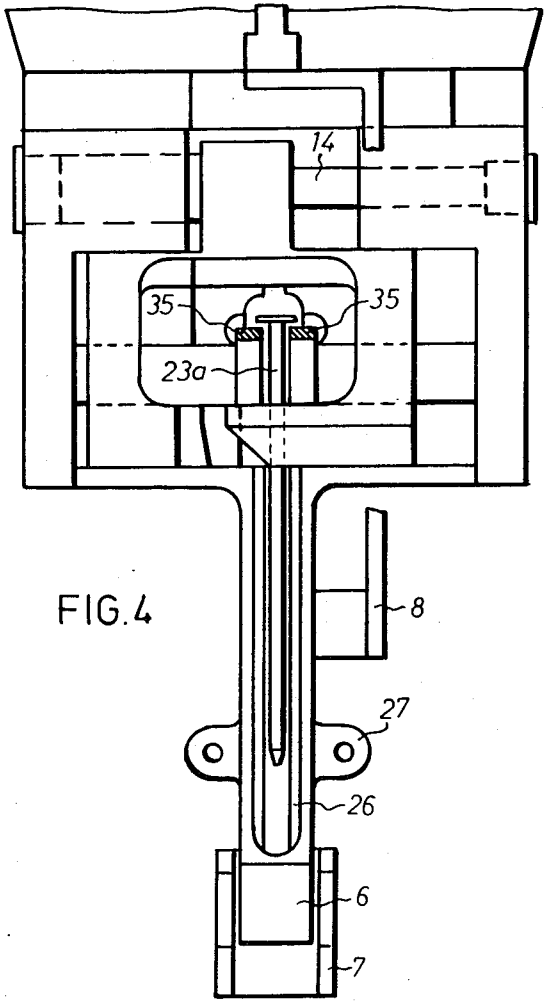
FIGS. 3 and 4 are similar views as that in FIG. 2, but show the separating member in different positions.
Figure 3:
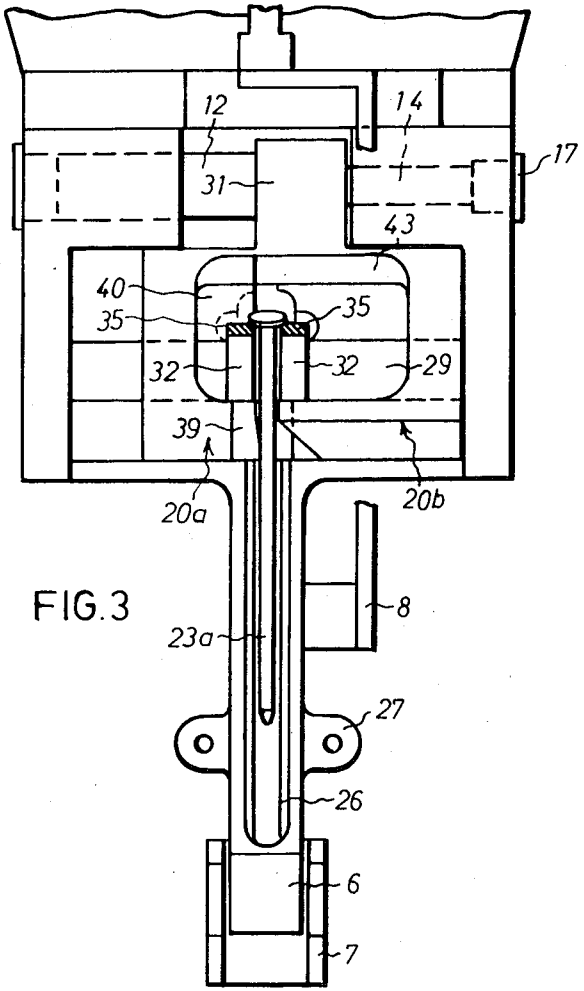
Figure 8B:
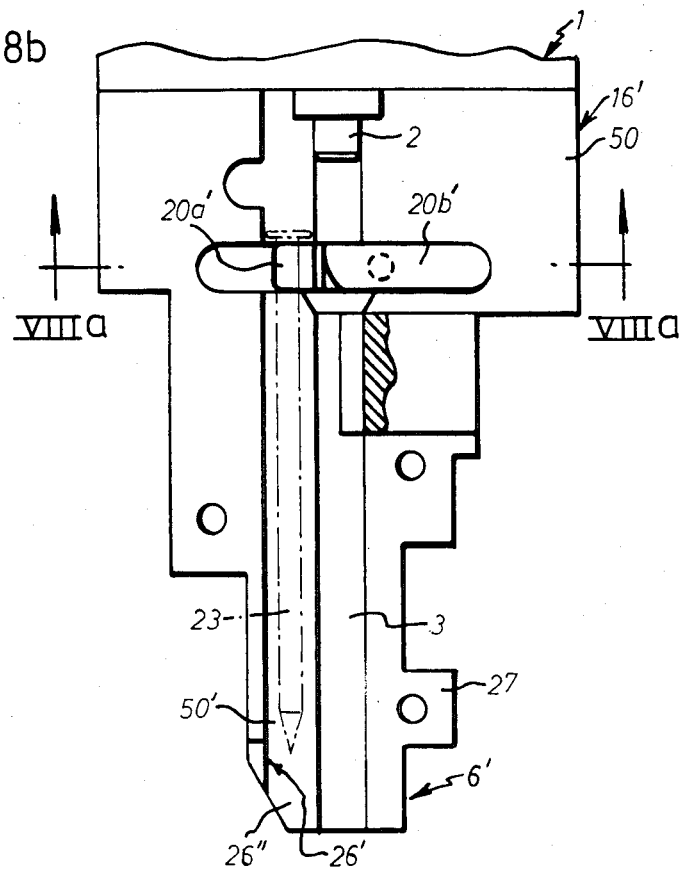
Figure 8A:
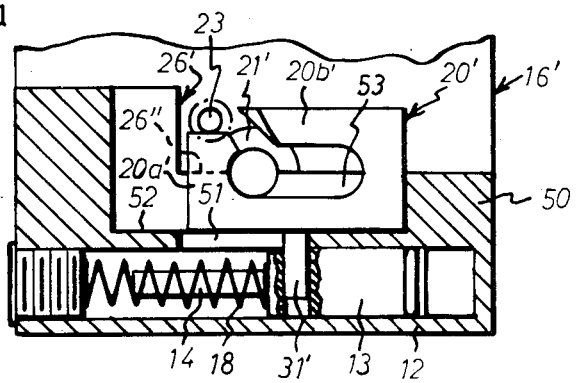
Figure 9:
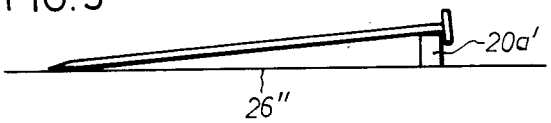

FIG. 8*b* shows a modification of the portion of the apparatus shown in FIGS. 2–4 and represents a preferred embodiment thereof;

FIG. 8*a* is a cross-sectional view taken along the line VIII*a*–VIII*a* in FIG. 8*b*; and FIG. 9 shows in a schematic view the position of a nail supported in an inclined position by one arm of the separator member and by a supporting surface of a guide member immediately before the moment in which the nail is fed into the space defined by the arms of the separator.

Figure 1:
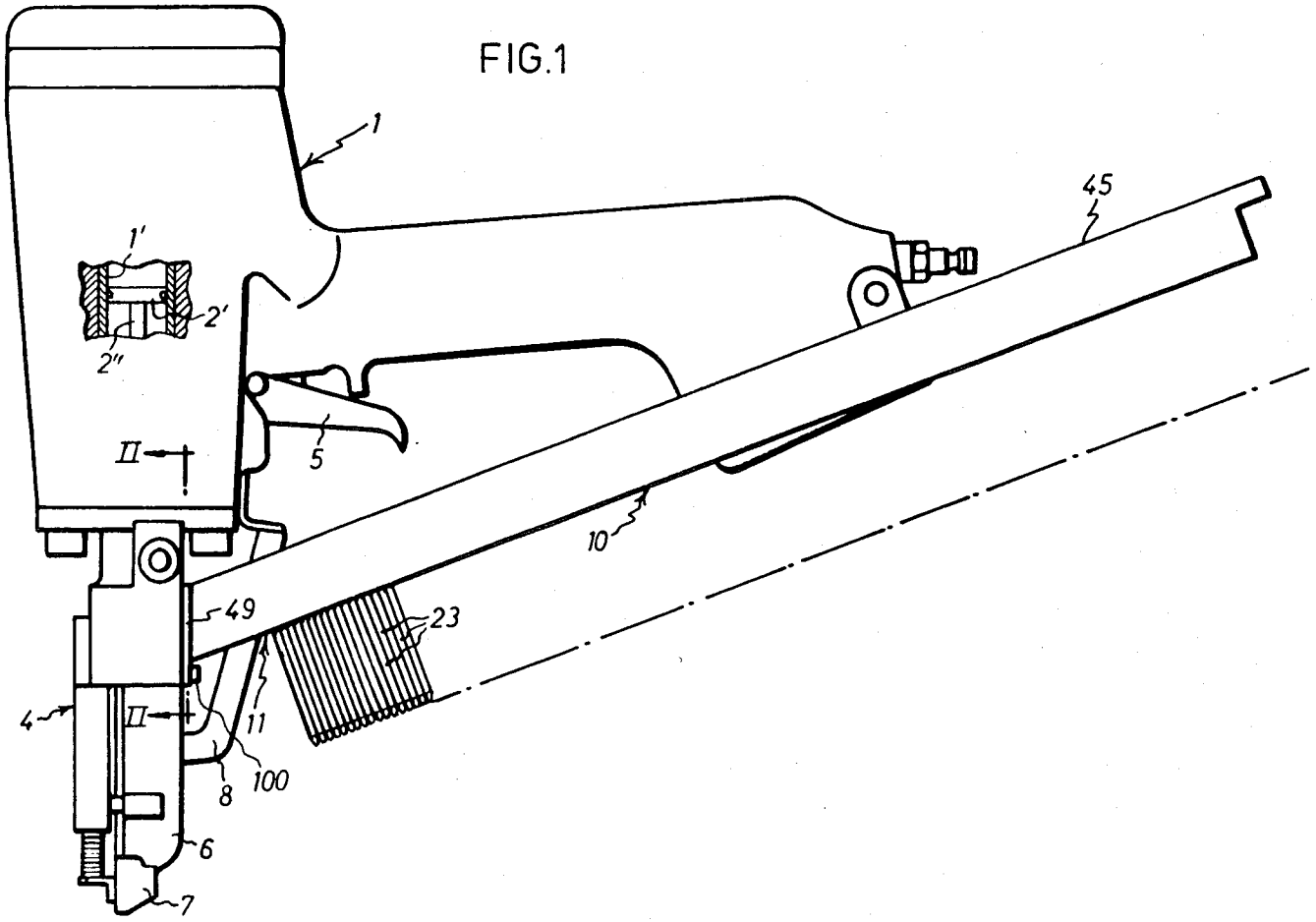
FIG. 1 shows a fastener driving apparatus equipped with feeding mechanism and fastener separating means according to the invention.

The driving apparatus in FIG. 1, which is equipped with a fastener feeding mechanism and separating means, is shown in the form of a so-called nailing gun with an arrangement for the supply of bulk nails, i.e. nails not laterally interconnected to form a strip of nails. The upper part 1 of the apparatus contains a main cylinder 1′ with a piston 2′ and a piston rod 2″ which constitutes the nail driver 2 of the nailing gun for firing nails through a firing track 3 in the nose portion 4 of the nailing gun (see also FIG. 2). The pison in the main cylinder is driven by pressure air. The firing by means of a trigger 5 can be performed only after the nose 6 of the nailing gun has been pressed against the work into which nails are to be driven, so that a safety valve (not showm) is operated by pressure against a foot portion 7 and rearward displacement of a link 8.

These parts of the apparatus are not described in detail as they can coincide in principle with corresponding parts of a conventional fastener driving apparatus and particularly a nailing gun.

At 10 there is shown a nail magazine having a nail feeding track for feeding bulk nails to the firing track 3 via a feeding mechanism generally designated 11 in FIG. 2 and constituting the main part of the present invention.

The feeding mechanism 11 comprises a cylinder 12 which via a control valve (not shown) may be adapted for control by the operating stroke or the return stroke of the driver 2 of the nailing gun for admission of pressure air to the piston 13 in the cylinder 12 for displacement thereof to the right with regard to FIG. 2. According to the embodiment shown in FIGS. 2–6 the common longitudinal axis of the cylinder 12 and the piston 13 extends perpendicularly to but is laterally offset from the longitudinal axis of the nail driver 2, said axis being located with regard to FIG. 2 beyond the plane of the Figure in order that the piston rod 14 and the nail driver 2 will never make contact with or obstruct one another. The piston rod 14 extends with its outer end portion into and is guided in a guide in the form of a bore 15 in an intermediate piece designated 16 between the upper part 1 and nose portion 4 of the nailing gun. In this intermediate piece which is detachably connected to the part 1 by dovetail guides and clamping screws 100 the cylinder 12 and the guide 15 are formed as bores in wall portions on either side of a plane along the longitudinal axis of the nail driver 2 which is perpendicular to the plane of FIG. 2.

The return stroke of the piston 13 may be effected by an elastic return means, such as the mechanical return spring 18 shown in FIG. 2. However, this mechanical spring can be replaced by an air spring, i.e. the end of the piston rod 14 can serve as a piston in a guide 15 which contains a pressure air cushion. When the piston 13 is moved to the right with regard to FIG. 2, the compressible elastic return means in the guide 15 is further compressed, and when the cylinder 12 behind the piston 13 after the operating stroke thereof is automatically connected to a discharge by the above-mentioned control valve, compressed air in the guide 15 is not able to move the piston/piston rod assembly 13, 14 back to the left. With this arrangement, the presetting of the return spring/air spring is readily controlled by adaptation of the precompression pressure.

Connected to the piston rod 14 is a combined nail gate and separating member 20 which comprises a nail passage 21 and a nail separator 22. The separating member 20 is reciprocable by means of the piston rod 14 and is adapted to allow one nail 23 at a time to reach the firing track 3 and to separate the next following nail in a row of nails, and thereby the entire row, from the firing track.

The separating member 20 is in the form of a flat slide which is guided in an exact straight path of movement by means which comprise guide rails and guide grooves at the back of the slide and guide surfaces facing the back of a slide and provided in a preferably rectangular recess 24 in the intermediate piece 16.

The magazine 10 illustrated in FIG. 1 and shown disassembled in FIG. 2 is to be connected by means of screws 100 to the lower part of the driving apparatus shown in FIG. 2 so as to engage a planar seating surface 25 formed on the intermediate piece. In this mounting position a nail guiding channel between, and defined by, a pair of parallel guiding rails 48 of the magazine 10 opens into a guide channel 26 between, and defined by, two pairs 32—32, 32'—32' of guide members supported by the intermediate priece 16 and in the shank-shaped nose portion 4, respectively. Said nose portion may be formed integrally with the intermediate piece 16 or may be divided in the longitudinal direction, the parts being interconnected by means of screws (not shown) inserted in lugs 27.

The guide channel 26 communicates over its entire length with the firing track 3, the upper end of which communicates with a widened recess 28 formed in the bottom of the piece 16 to facilitate the passage of the heads of nails fed to the track 3. The track 3 has a sufficient transverse dimension to permit the nails and the heads thereof to pass along the firing track. As will be evident from the following, the space between the upper guide rail members 32 may be relatively narrow and may correspond to the distance between the guide rails 48 in the magazine. The outer ends of these rails 48 form a pair of tongues 35 which extend out of the magazine at the end thereof adjacent to the apparatus 1 proper.

In the intermediate piece 16, more exactly in the region of its recess 24, there is also formed a transverse guide rail 29 which projects some distance outward from the bottom of the recess and serves as a guide rail for the slide 20 which accommodates the guide rail 29 in guide grooves 30 which are provided in the rear face of the slide. The slide 20 guided on the guide rail 29 rests with its rear face on either side of the guide rail against planar surfaces of the intermediate piece 16 on either side of the guide rail 29. The slide is connected to the piston rod 14 via a boss 31 which may be formed integrally with the slide. This boss 31 has a threaded opening 31' through which the piston rod 14 extends and to which the piston rod is connected by thread at 31''. A reliable locking may be effected by means of a transverse locking screw (not shown), but the piston 14 and the boss 31 may also be interconnected in a manner other than by means of a thread connection.

The channel 26 between the upper guide rails 32 divides the guide rail 29 into two halves in that it penetrates the guide rail 29. The upper guide rail members 26 which form an upper part of the channel 26, may be formed as projections of the adjacent ends of rail parts 29, and the upper ends of the rail members 26 are formed to support the projecting tongues 35 of the guide rails in the nail magazine. As mentioned above, the distance between the guide members 32 corresponds to the distance between the tongues 35 of the guide rails in the magazine.

Figures 5, 6:
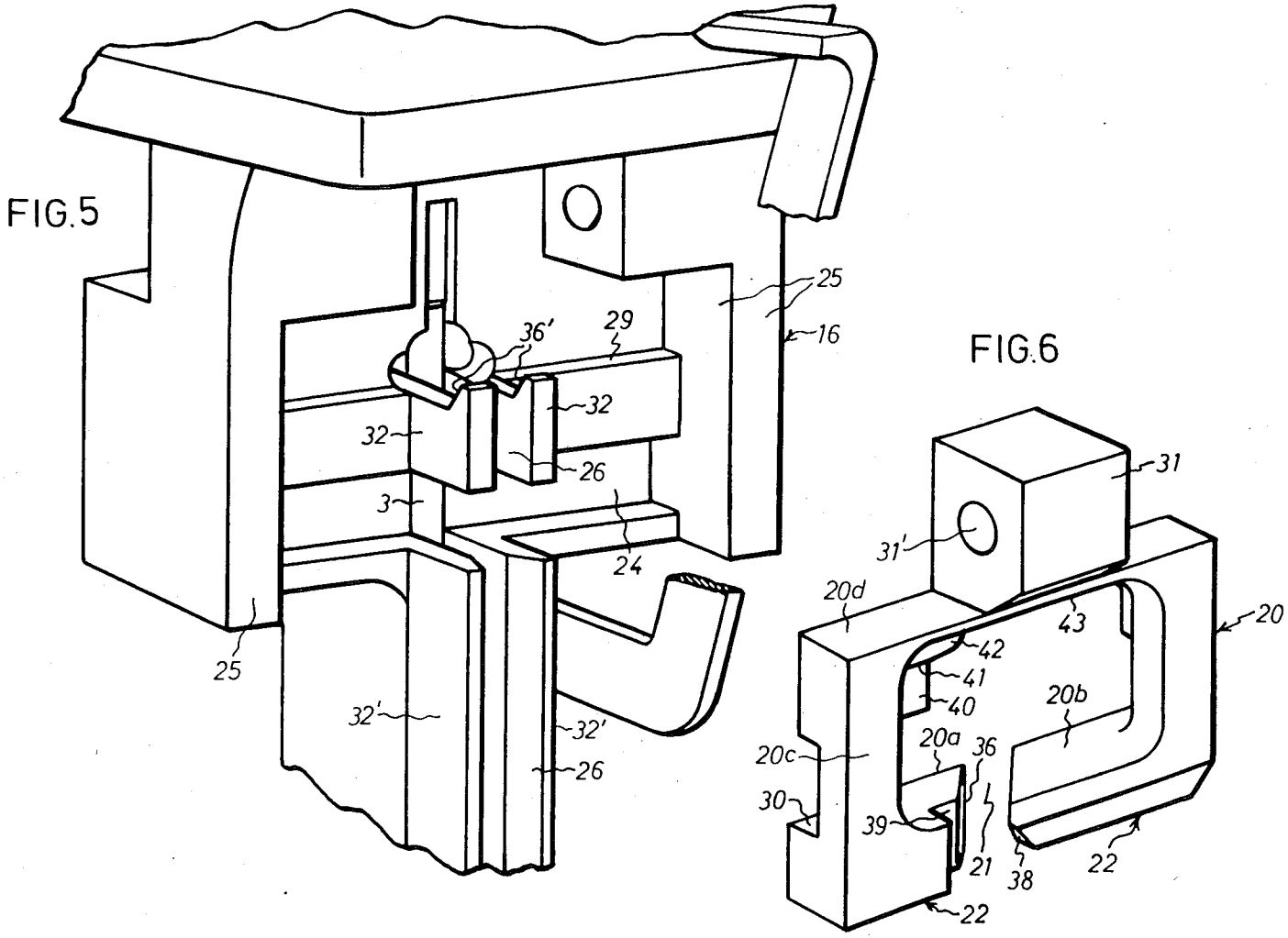
FIG. 5 is a perspective view on a larger scale of a part of FIG. 2 after removal of the separating member.
FIG. 6 is a perspective view of the separating member.

As shown in FIG. 6, the slide 20 is in the form of a rectangular plate having an approximately rectangular through opening in its mid-section. By the provision of the rectangular opening the slide may be said to be in the form of a rectangular frame. The lower wall of the frame is divided by a slot 36 into two halves **20*a*, 20*b*. The slot 36 does not extend perpendicularly through the lower frame wall but is at an oblique angle to the slide plane. The two frame wall members 20*a*, 20*b* form a pair of arms having planar, but oblique, facing parallel end surfaces 36*a*, 36*b*. The right-hand frame wall member or arm 20*b* with regard to FIG. 2 has adjoining its lower edge a bevel forming an oblique planar surface 37, and in addition the frame wall 20*b* at the end terminating at the slot 36 has a bevel at 38**.

It should also be observed that the second, lower frame wall member or arm **20*a* adjoining the slot surface 36 has a recess 39 with planar bottom and side walls, the side wall of the recess being formed where the oblique surface 36 would otherwise reach the outer side of the slide (see FIG. 2**).

The left-hand corner portion of the frame-shaped slide (see FIG. 2) may support an embossment 40 of relatively small thickness. The rear side of this embossment is on a level with the rear face of the slide. Said embossment extends to and is limited by the guide groove 30 of the slide. The width of the embossment 40 is equal to or somewhat smaller than the length thereof. The embossment 40 merges into the upper frame wall **20*d* via an abutment 41 and an oblique surface 42 which in turn is delimited from a slanting surface 43 which may form a sliding surface for nail heads in the region between the tongue 40 and the opposite short side 29*d*** of the frame.

The surfaces described above are advisable in the embodiment of the separating slide 20 according to FIGS. 2–4 and 5, where the frame-shaped slide is positioned in a vertical plane which is parallel to the longitudinal axis of the firing track 3 and transversely offset in relation to this axis.

In operation, the slide is reciprocated as a shuttle which alternately separates and allows the nails to pass from a row 23 of nails which is advanced in the nail channel of the magazine by any conventional pushing means, such as a movable plate and a compressed spring in the magazine at the rear end of the row 23. As shown, the nails are suspended in the magazine with their heads supported by the rails 48.

The facing end surfaces of the arms **20*a*, 20*b* of the separating member 20 form cam surfaces, and the distance between these cam surfaces 36*a*, 36*b* is sufficient to let the shank of a nail pass. When the slide 20, i.e. the separating member, is moved to the right from the left-hand end position in FIG. 2 (in the direction of the arrow in FIG. 3) by admission of compressed air to the cylinder 31, the arm 20*b* is moved from the nearest nail 23 in a row of nails, which nail—as long as the arm 20*b* obstructs the way to the slot 26—is retained in the position shown in FIG. 2. When the slide reaches the right-hand end position in FIG. 3 the end of the arm 20*b* allows the nail to pass a small distance towards the firing track, but it is stopped at the mouth of the slot between the surfaces 36*a*, 36*b* by an abutment surface 39 on the arm 20*a*. This is an at-ready position for further advance of the nail 23 in FIG. 3. In this position a following nail (not shown) is located with its shank adjcent or close to the nail 23 in FIG. 3. When the slide moves from the right-hand end position in FIG. 3 to the left the abutment surface 39 is moved away from the nail 23 and at the same time the arm 20*a* moves forward and separates the nail 23 from the next following nail (see FIG. 2). When the abutment surface 39 completely leaves the nail 23 by a displacement of the slide to the left (FIGS. 3 and 4) the nail slides in between the oblique cam surfaces 36*a*, 36*b*. As the displacement of the nail to the left together with the slide 20 is prevented by the nail shank being supported against the right-hand guide rail 32, the nail is moved transversely towards the firing track by means of the oblique cam surface 36*b* on the arm 20*b*. At the same time as the nail starts its movement towards the firing track 3, the nail head slides on and leaves the tongues 35 and is moved into the recess 28. The nail head is then in position in the firing track 3 to be fired and is retained in this position in conventional manner by a magnet device (not shown) in the firing track. The firing stroke can be started already in the position illustrated in FIG. 4 and is terminated in the position illustrated in FIG. 2, where the next nail is already in position to be separated. At the same time as the return stroke is initiated, the cylinder 21 is again supplied with compressed air and, as a result, moves from the position in FIG. 2 to the position in FIG. 3 while the described procedure for the feeding of the nail shown in FIG. 2** is repeated.

It will appear from the above description and from FIGS. 2–4 that each nail which is in turn for being fed into the firing station, is safely kept out of the way of the firing stroke for the nail positioned in the firing track, and that the slide 20 automatically ensures that a gap is formed between the nail which is in turn for being fed and the next following nail by the small movement towards the firing track which is imparted to the nail when it is fed into the at-ready position in FIG. 3 immediately before the edge-like end of the arm **20*b* in almost the same instant is inserted between the nail 23*a* in FIG. 3 and the nail 23 in FIG. 2, definitely separating these nails from one another, simultaneously as the nail 23*a* is positively moved into the firing station in FIG. 4**.

As illustrated in FIG. 3, the embossment 40 constitutes a means for making—similarly to the leading end of the abutment surface 34—an unintentional admission of a nail into the firing track impossible when the nail is moved to its at-ready position in FIG. 3. The embossment 40 lies in FIG. 3 with its right-hand edge substantially on a level with the right-hand side of the left-hand nail 32 beyond the nail head, and only when the slide has been moved some distance to the left from the position in FIG. 3, it opens the way for the nail head and for the described nail feeding movement. The described oblique lower surface 37 of the arm **20*b* ensures that the movement of the slide from the position in FIG. 2 to the position in FIG. 3 can be effected without any obstacle even if a nail is fed in an obliquely depending position from the magazine. The oblique surface 43 on the upper wall of the frame-shaped magazine constitutes a sliding surface which prevents that a nail which is being fed and for some reason takes an unintended high position, is stopped against the slide 20**.

It should be noted that the path of movement of a nail to the firing track 3 from the position in which the nail is to be separated by the arm **20*b*, is not a straight path directly to the firing track 3**.

Initially, the nail is moved perpendicularly to the slide 20 to a position in which it is stopped by the arm **20*b*. When the slide is moved in the direction to the right from the position in FIG. 2, the nail 23 shown in FIG. 2 slides in relation to the arm 20*b*, and when the nail leaves the end of the arm 20*b*, it is moved by pressure force from the row of nails behind to a stop position against the abutment surface 39 of the arm 36*a***.

During the movement of the slide to the left, the nail is moved transversely to the left in the guide channel 26 and to an abutment which is formed by the left-hand rail 32, 32' in FIG. 5. When the movement of the slide 20 proceeds to the left (FIG. 3), the separation of the nail **23*a* is facilitated by the support of the nail against the left-hand rail 32, 32', whereby the nail is forced by the cam surface 36*b* to pass through the slot 21. However, during a short moment, when the nail still is supported on the arm 23*a*, the nail is tilted about the arm 23*a* to an inclined position in which the pointed end or the nail is supported by the bottom surface of the firing track 3. This position corresponds in principle to the position shown in FIG. 9**.

This controlled tilting operation by means of the separating slide 20 is a very important feature which ensures that the nail will be delivered with the pointed end directed downwardly and with a tendency to contact the bottom or rear surface 26' of the firing track. If, on the contrary, the nail is delivered in a position in which its head tends to lean on the bottom surface 26' and the shaft of the nail is inclined downwardly and outwardly from this bottom surface, there is a risk that the nail will be turned upside down, or that the nail will be bent by the blow of the driver 2.

Figure 7:
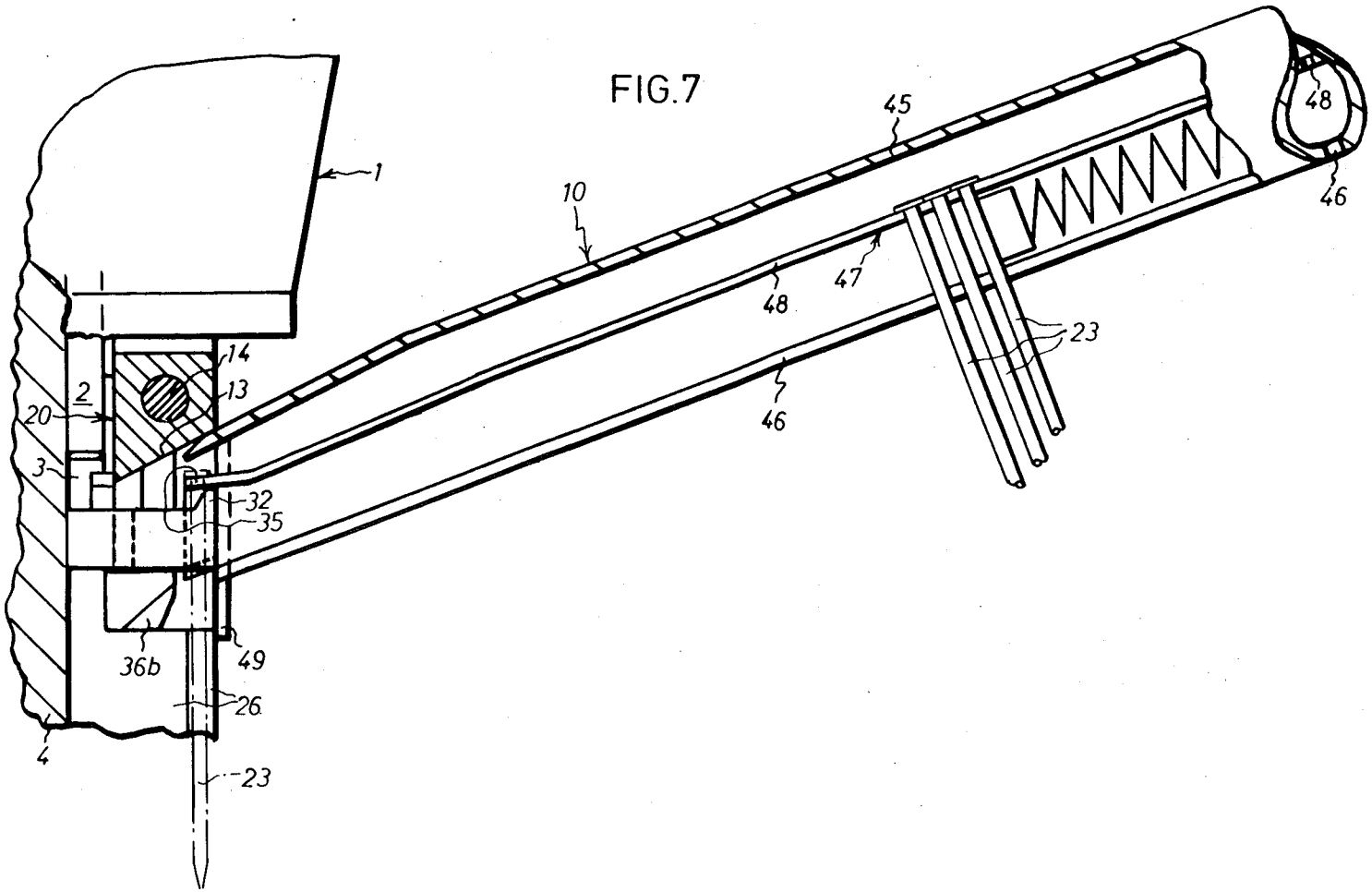
FIG. 7 shows a longitudinal section of the magazine and its connection with the apparatus of FIG. 1.

In FIGS. **8*a* and 8*b*, where similar reference numbers are used for details which are similar to or equivalent with details in FIGS. 2–6, there is shown an essentially simplified but technically improved embodiment of the feeding and separating mechanism. The separating member which is here designated 20', corresponds in principle to the separating member 20 in FIGS. 1–4 and is reciprocable in a guide driven by a cylinder and piston assembly 12, 13, 14 and a return spring 18. For simplification of the description, the separating member 20' may be said to be substantially of the same fundamental design as that in FIGS. 2–4, the difference being that it is horizontally positioned, i.e. such that its plane is perpendicular to the driver rod 2. Also in this instance, the separating member 20' is in the form of a frame having one frame wall cut by an inclined slot 21' which divides this frame wall into two parts which form two arms 20*a*', 20*b*'. The arm 20*a*' corresponds to but is shorter than the arm 20*a* in FIGS. 2–4, and the arm 20*b*' corresponds to but is longer than the arm 20*b* in FIGS. 2–4. Further essential differences are that the driver 2 at the firing stroke passes through the central hollow space in the frame, which forms the separating member or slide 20', and that the guide channel 26 to which the magazine 10 in FIG. 1 and FIG. 7 is intended to deliver nails 23, in FIG. 8*b* is in the form of a groove 26' formed in the intermediate piece 16' and the nose portion 6'. This groove 26' is parallel to the track 3 and has a planar bottom surface 26'' which merges with the adjacent side of the firing track 3, as shown in FIG. 8*a***.

Because of the fact that the slide 20' in the embodiment according to FIGS. **8*a*, 8*b*, is horizontally positioned, whereas the slide in FIGS. 1–6 has a vertical position, the slide guiding surfaces for the slide 20' are different and essentially simplified. Thus, most of the guiding elements and guiding surfaces shown in FIGS. 5 and 6 are eliminated in the embodiment according to FIGS. 8*a* and 8*b***.

Thus, the slide 20' is guided in a slide guide 51 arranged in the intermediate piece 16'. This slide guide may comprise an opening in a wall member 50 wherein also the cylinder 12 is formed. Through a slot 51 in the cylinder housing 50 a connecting arm 31' extends to the slide 20'. Guide surfaces for the slide are shown at 52 and 53 in FIG. **8*a***.

The ends of the arms **20*a*', 20*b*' and the slot 21' therebetween are adapted to separate and displace fasteners delivered from the magazine 10 (FIG. 1) substantially in the manner described above with reference to FIGS. 1–6. However, as a result of the fact that the longitudinal axes of the groove 26' and the firing track 3 are transversely spaced, the non-straight path of movement which is disclosed in connection with this embodiment is thus distinguished from the straight path of the embodiment of FIGS. 2–6, will be more pronounced. Thus, in the embodiment according to FIGS. 8***a* and 8*b*, this movement will be generally L-shaped, as is evident from FIG. 8*b* and from the fact that the nail 23 is delivered from the magazine 10 (FIG. 1) perpendicularly to the plane of FIG. 8*b*. The nail is delivered from the magazine by means of push springs therein to a position in engagement with the slide arm 20*b*′, as described with reference to FIGS. 2–6, but with the difference that the nail in this position is transversely spaced from the longitudinal axis of the firing track. When the slide is moved in the left-hand direction from its right-hand end position, the nail is separated from the row of nails and moved through the slot 21′, but during a very short moment, before the nail passes through the slot 21′, it will be tilted to the position shown in FIG. 9. Thereupon, and because of the distance between the axes mentioned above, the nail has to be moved to the right from the position in FIG. 8*b*, which is possible thanks to the inclination of the slot 21′. It may be postulated, however, that a nail will not arrive at the bottom or rear surface of the firing track during the separating movement of the slide to the left and in spite of the assisting attraction from the magnet 55, but in such a circumstance the other arm 20*a* will give the nail a kick in the right direction, when the slides returns to its right-hand end position.

A nail advanced to the firing station in the firing track 3 below the driver rod 2 is caught by the magnet 55 which receives the nail in an already inclined position and will hold it suspended in a free but, as described in the above, preferred inclined position for firing. In this instance the nail shank depends through the central hollow space in the transverse slide. During the firing stroke the driver rod thus freely passes through the opening in the frame-shaped slide. A further advantage is that the slide in this case, because of its position, constitutes a frame about the nail to be fired, and when it is fired, and thus contributes to preventing the nail from keeling over.

The above-described free position of the slide, that is a free position for all parts of the slide in relation to the path of movement of the driver rod 2, is also attained, according to FIGS. 8*a* and 8*b*, in that the drive rod is guided in a path through the central opening of the slide.

FIGS. 1 and 7 show the preferred embodiment of a nail magazine 10 referred to above. This magazine comprises a tubular member 45 having a longitudinal slot 46 in its bottom and two parallel guide rails 47 fixed by welding in the interior of the tube 45 close to the upper side opposite to the slot 46, and delimiting a slot 48 located parallel to and opposite the lower slot 46. The two guide rails 47 present two extensions projecting from the magazine and forming the guide tongues 35 which are bent upwardly in a non-parallel relationship (at an oblique angle) to the inner or top portions of the rails before they are introduced into the driving mechanism by virtue of the angular transmission which the nails must undergo. These tongues have already been broadly described and are shown in section in FIGS. 2–5. The tube is provided at the front end with lugs 49 welded thereto and having holes for their fixation by means of screws 100 against the seat 25 of the intermediate piece 16 or 16′. These screws cannot be disposed in the screw holes in the seat 25 unless the tube is correctly placed with the tongues 35 resting in the correct position on projecting studs of the guides 32.

The tongues 35, by being curved upwardly, tend to separate the shanks of the outermost shanks from the rest of the row of nails in the magazin, which will facilitate the separating operations of the slide.

The invention is not limited to the preferred embodiment illustrated and described above, but can be modified in several ways within the spirit and scope of the invention. Such possible modifications apply for instance to the surfaces 39, 43 and the tongue 40. The oblique surface 43 is usually not necessary. The tongue 40 and the abutment surface 39 have a complementary function with regard to one another, and the tongue 40 may be dispensed with. The abutment surface 39 which has the task of assisting the end of the arm 20*b*, immediately before the stroke of the slide to the right, in spacing two adjoining nails apart, could of course be given a design other than that shown. The facing guide surfaces of he slide and the intermediate piece may be formed in another manner or be replaced by other guides. As already hinted at in the foregoing, the arm 31 could be connected in another manner to the piston rod 14, and the piston 13 in the cylinder 12 could be driven by operating pressure instead of by the return air pressure for the main cylinder of the apparatus and could be controlled by the operating stroke of the apparatus via a control valve. As a magazine instead of the illustrated preferred magazine there could be used a conventional magazine which supplies the fasteners directly onto support surfaces of the studs 32, in lieu of the illustrated tongues 35 resting on the studs. However, the illustrated and described magazine is preferred because it represents an extraordinarily simple, light-weight and inexpensive, but nevertheless strong construction in which the extended tongues of the guide channel constitute a simple and practical complement of the guiding of the fasteners into said channel. Modifications of the kind hinted at in the foregoing fall within the spirit and scope of the appended claims.

We claim:

1. A driving apparatus for fasteners, each of which comprises a shank with a head at one end and an opposite end formed to be driven into a workpiece, such as nails, the apparatus comprising a housing having a nose portion, means including a reciprocable power driven first piston serving as a fastener driver and movably mounted in said housing, said nose portion having a guide means which forms a driver guide for said driver and a firing track for guiding fasteners which are to be moved along said track into a workpiece one by one by a blow from said driver at each driving stroke thereof, said driver guide and said firing track having a common longitudinal axis, a magazine having a guiding device for a row or said fasteners, a pair of tongues extending from said guiding device and defining a groove therebetween for receiving said fasteners from said guiding device, said groove and said firing track being non-coaxial, a feeding mechanism for feeding of one said fasteners at a time from said groove into the firing track, said feeding mechanism comprising a reciprocally mounted slide means having parallel spaced apart major faces, said faces having a cross-section greater than the distance between them, said slide means separating the outermost one of said fasteners in said row from the following fasteners to permit the outermost fastener to be moved laterally with respect to said groove into a firing position in said firing track by means of said feeding mechanism, said nose portion having a transverse means slide guide for guiding said reciprocable slide back and forth along a path extending at least substantially perpendicular to and through the path of movement of the row of fasteners towards the firing track, the path of movement of said slide extending substantially perpendicular also to said common longitudinal axis of said driver guide and said firing track, slide driving means for reciprocation of said slide means in timed relationship with the operation of said driver, said nose portion further comprising a fastener receiving station arranged therein for receiving each of said fasteners fed from said magazine, channel means and means for placing said magazine in communication with said channel means, said channel means comprising a fastener supporting surface which extends substantially perpendicular to said slide guide and substantially parallel to said firing track, said slide means comprising first and second projections having adjacent spaced-apart ends which define a passage for fasteners therebetween, said first projection having means arranged to form a temporary obstacle to movement of the outermost one of said fasteners in said row, and said second projection forming a fastener separating member which, when said slide is moved in one direction, is movable in between said outermost and next following one of the fasteners in said row to separate said outermost fastener in the row from the other fasteners therein, said second projection comprising means for pushing said outermost fastener laterally to a resting position in contact with said supporting surface and for moving said separated fastener from said resting position to said station to said firing position in said firing track, and said nose portion comprising magnetic means for maintaining said fastener in said firing position until being struck by said driver and thereby moved along said track into said workpiece.

2. An apparatus as claimed in claim 1, wherein said transverse slide guide is formed in said nose portion to guide said slide means along a path in which said projections of the slide are moved laterally offset in relation to said driver guide and said firing track, such that any physical contact between said driver and said slide means projections is prevented in all positions of said slide means and driver during their reciprocal movements.

3. An apparatus as claimed in claim 1, wherein said slide means is in the form of a rectangular frame having a pair of opposite end wall members and opposite side wall members, said wall members framing a central opening, one of said side wall members having a slot forming said passage and extending substantially transversely therethrough, the portions of said one wall member on either side of said slot forming said first and second projections, at least said second projection presenting an end surface which is oblique to the plane of said frame and forms an acute angle in relation to the longitudinal axis of said transverse slide guide, said first projection comprising a recess formed to catch said fastener to be separated by said second projection, said slot between said projections providing a gating action by reciprocal movement of said slide means and said recess forming an obstacle to be positioned temporarily in a rest position to prevent unexpected movement of the fastener into said slot.

4. An apparatus as claimed in claim 1, wherein said slide driving means comprises a single-acting cylinder which houses a second piston movable in one direction by the action of pressurised air, said slide driving means further comprising spring means for returning said second piston in the opposite direction, the pressurised air supplied to said cylinder being controlled by the stroke of said first piston, and wherein said slide driving means is spaced apart from the slide means proper.

* * * * *

UNITED STATES PATENT AND TRADEMARK OFFICE

CERTIFICATE OF CORRECTION

PATENT NO. : 4,809,900

DATED : 7 March 1989

INVENTOR(S) : Ragnar Ingelsten

It is certified that error appears in the above-identified patent and that said Letters Patent is hereby corrected as shown below:

Column 1, line 4, "isa continuatrion" should be --is a continuation--;

Column 1, line 21-22, "fasteners" is divided incorrectly;

Column 2, line 2, "4,463 888" should be --4,463,888--;

Column 5, line 64, "pison" should be --piston--;

Column 7, line 6, "priece" should be --piece--;

Column 7, line 39, after "thread" insert --engagement--;

Column 8, line 57, "20a" should be --20b--;

Column 10, line 2, "or" should be --of--;

Column 12, line 5, "magazin" should be --magazine--;

Column 12, line 20, "he" should be --the--;

Column 12, line 50, after "guiding" insert --said--;

Column 12, line 55, "or" should be --of--;

UNITED STATES PATENT AND TRADEMARK OFFICE

CERTIFICATE OF CORRECTION

PATENT NO. : 4,809,900

DATED : 7 March 1989

INVENTOR(S) : Ragnar Ingelsten

It is certified that error appears in the above-identified patent and that said Letters Patent is hereby corrected as shown below:

Column 13, line 3, before "back" insert -- means --.

Signed and Sealed this

Fifth Day of December, 1989

*Attest:*

JEFFREY M. SAMUELS

*Attesting Officer*

*Acting Commissioner of Patents and Trademarks*